US009375090B2

(12) United States Patent
Gambino

(10) Patent No.: US 9,375,090 B2
(45) Date of Patent: Jun. 28, 2016

(54) ROTATABLE AND COLLAPSIBLE CHAIR

(71) Applicant: Carlo Gambino, Myrtle Beach, SC (US)

(72) Inventor: Carlo Gambino, Myrtle Beach, SC (US)

( * ) Notice: Subject to any disclaimer, the term of this patent is extended or adjusted under 35 U.S.C. 154(b) by 80 days.

(21) Appl. No.: 14/205,638

(22) Filed: Mar. 12, 2014

(65) Prior Publication Data

US 2014/0265459 A1 Sep. 18, 2014

Related U.S. Application Data

(60) Provisional application No. 61/777,156, filed on Mar. 12, 2013.

(51) Int. Cl.
*A47C 3/18* (2006.01)
*A47C 4/10* (2006.01)

(52) U.S. Cl.
CPC .... *A47C 3/18* (2013.01); *A47C 4/10* (2013.01)

(58) Field of Classification Search
None
See application file for complete search history.

(56) References Cited

U.S. PATENT DOCUMENTS

| | | | | | |
|---|---|---|---|---|---|
| 1,128,411 | A | * | 2/1915 | Cleveland | 297/381 |
| 1,788,801 | A | * | 1/1931 | Mintz | 5/125 |
| 2,855,986 | A | * | 10/1958 | Engelen, Sr. | 297/382 |
| 2,876,825 | A | * | 3/1959 | Boortz | 108/132 |
| 2,916,084 | A | * | 12/1959 | Bottemiller et al. | 248/625 |
| 3,007,737 | A | * | 11/1961 | Lichter | 297/378.1 |
| 3,635,521 | A | * | 1/1972 | Shivvers | 297/125 |
| 4,482,184 | A | * | 11/1984 | Mincey | 297/28 |
| 4,544,202 | A | * | 10/1985 | Keaton | 297/344.22 |
| 4,674,793 | A | * | 6/1987 | Kettler | 297/28 |
| 4,824,170 | A | * | 4/1989 | Goldmeier | 297/344.26 |
| 4,871,209 | A | * | 10/1989 | Handelman | 297/378.1 |
| 5,039,164 | A | * | 8/1991 | Gibbs | 297/302.1 |
| 5,046,782 | A | * | 9/1991 | Lundeen | 297/344.26 |
| 5,078,451 | A | * | 1/1992 | Sobel | 297/344.26 |
| 5,364,166 | A | * | 11/1994 | Zegeer | 297/411.39 |
| 5,395,157 | A | * | 3/1995 | Rollo et al. | 297/344.26 |
| 5,451,093 | A | * | 9/1995 | Petrie et al. | 297/137 |
| 5,688,211 | A | * | 11/1997 | Myers | 482/66 |
| 5,690,385 | A | * | 11/1997 | Feldman et al. | 297/344.26 |
| 6,315,360 | B1 | * | 11/2001 | Guerrini | 297/344.21 |
| 6,890,033 | B1 | * | 5/2005 | Casella | 297/344.21 |
| 6,896,330 | B1 | * | 5/2005 | Yu | 297/344.21 |
| 7,032,966 | B2 | * | 4/2006 | Myers | 297/137 |
| D526,135 | S | * | 8/2006 | Murphy | D6/361 |
| 7,325,875 | B1 | * | 2/2008 | Guerrini et al. | 297/344.21 |
| 7,328,952 | B2 | * | 2/2008 | Guerrini | 297/344.21 |
| 7,540,567 | B1 | * | 6/2009 | Gambino | 297/344.26 |
| 7,717,514 | B2 | * | 5/2010 | Redmann | 297/313 |
| 7,967,383 | B2 | * | 6/2011 | LaPointe | 297/344.26 |
| 8,979,184 | B2 | * | 3/2015 | Stafford et al. | 297/16.2 |
| 2008/0001460 | A1 | * | 1/2008 | Zhang | 297/411.39 |
| 2011/0163586 | A1 | * | 7/2011 | Findlay | 297/344.26 |

* cited by examiner

*Primary Examiner* — Charles A Fox
*Assistant Examiner* — Christopher E Veraa
(74) *Attorney, Agent, or Firm* — James Ray and Assocs; Alexander Pokot

(57) ABSTRACT

A chair comprises a seat, a back, a pivotal connection between the back and the seat, a pair of arms, each in a pivotal connection with the seat and the back, plurality of legs, a rotational connection between the seat, the back and the pair of arms relative to the plurality of legs and a pivotal connection between one end of each leg and the seat.

16 Claims, 9 Drawing Sheets

ROTATABLE AND COLLAPSIBLE CHAIR

CROSS-REFERENCE TO RELATED APPLICATIONS

This application is related to and claims priority from U.S. Provisional Patent Application Ser. No. 61/777,156 filed on Mar. 12, 2013.

FIELD OF THE INVENTION

The present invention relates, in general, to lounge type chairs and, more particularly, this invention relates to a lounge type chair which can rotate about an axis of 360 degrees to follow the sun and, still more particularly, this invention relates to a lounge chair which is well suited for use at the beach and, still even more particularly, the invention relates to a lounge type chair which can rotate about an axis of 360 degrees to follow the sun and which is collapsible to make it easy to store and transport.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

It is generally well known to carry lounge chairs to sit in while at the beach, picnics, parks, outdoor concerts, sporting events and the like environments. These lounge chairs are normally made with an aluminum frame and plastic fabric to reduce the weight. It has been further found desirable to allow 360 degree rotation of the chair during use so as to follow the sun pattern or provide a better observation angle without the need to manually turn the base of the chair in relationship to the ground surface. While Applicant's prior U.S. Regular Utility Pat. No. 7,540,567 issued on Jun. 2, 2009 disclosed one embodiment of such chair, it has been determined that further improvements are needed.

SUMMARY OF THE INVENTION

The invention provides a chair that comprises a seat, a back, and a pivotal connection between the back and the seat. There is a pair of arms, each in a pivotal connection with the seat and the back. There is also a plurality of legs, each configured for movement between folded and extended positions. A rotational connection allows rotation or swivel of the seat, the back and the pair of arms relative to the plurality of legs.

The invention also provides a chair that comprises a seat having a generally planar upper surface and a generally planar bottom surface, a peripheral flange upstanding on the bottom surface, wherein a rear end of the seat is sized smaller than a remaining portion thereof and wherein the peripheral flange is defined by a tapered surface at the rear end. The chair also comprises a back having a generally planar upper surface and a generally planar bottom surface, a peripheral flange upstanding on the bottom surface of the back, and a pair of pins upstanding on an exterior surface of the peripheral flange diametrically opposite to each other, wherein a bottom end of the back is sized smaller than a remaining portion thereof and wherein the peripheral flange of the back is defined by a tapered surface at the bottom end. The chair further comprises a means for pivotally connecting the bottom end of the back to the rear end of the seat, the means including a hinge having a first portion disposed on the rear end of the seat and having a second portion disposed on the bottom end of the back, the first and second portions configured to interlock by way of a pin or snap type arrangement, the means enabling pivoting of the back between a first position wherein the back is disposed generally perpendicular to the seat and a second position wherein the back is disposed generally coplanar with the seat. There is a pair of arms. Each arm includes a first portion having a generally hollow interior defining a generally U-shaped cross-section of the first portion in a plane being transverse to a length thereof, a slot formed through a thickness of an interior leg adjacent a rear end of the first portion, the interior leg abutting or disposed in a closed proximity to an exterior surface of the peripheral flange of the back during use of the chair, the slot sized to receive a respective pin there through and an aperture formed through thicknesses of both legs adjacent a front end of the first portion. Each arm also includes a second portion sized to be received within the hollow interior of the first portion, the second portion having a pair of apertures, each of the pair of apertures formed through a thickness of the second portion adjacent a respective end thereof, and two pair of spaced apart brackets disposed on the top surface of the seat diametrically opposite to one another and having aperture formed through thickness thereof and aligned with apertures in one end of the second portion. There is also a base member configured to fit within a peripheral flange of the seat in a close proximity to a bottom surface thereof. A retaining member is provided and is secured with fasteners to a bottom surface of the seat. The retaining member is configured to retain an inner edge of the base member in a spaced relationship with the seat, the retaining member having a peripheral flange configured to abut the bottom surface of the seat and further has an edge portion thereof configured to abut the base member. A bearing assembly includes a bearing cage sized to fit within the base member and plurality of bearings fixed for a rotation along a circumference of the bearing cage. A surface of each bearing is disposed in an abutting contact with a surface of the base member. There is also a plurality of ribs, wherein one rib upstands on the bottom surface of the seat, distal ends of two other ribs upstanding on the bottom surface of the seat are disposed in an abutting contact with the surface of the base member so as to space the seat from the base member and to allow a rotation of the seat and the back in a relationship to the plurality of legs, another rib upstanding on the bottom surface of the seat and having a distal end thereof disposed in an abutting engagement with a surface of the bearing cage, and yet another rib upstanding on the bottom surface of the seat and having a distal end thereof disposed in an abutting engagement with a surface of the retaining member.

OBJECTS OF THE INVENTION

It is, therefore, one of the primary objects of the present invention to provide a chair that includes a seat and a back rotatable in a relationship to legs or base.

Another object of the present invention is to provide a chair that includes a seat and a back rotatable in a relationship to legs or a base and wherein the seat, back and legs are configured to collapse into a generally planar position for at least one of storage, carrying and/or transport.

Yet another object of the present invention is to provide a chair that includes a seat and a back rotatable in a relationship to legs by way of a ball bearing cage.

A further object of the present invention is to provide a chair that includes a seat and a back rotatable in a relationship to legs and wherein the back is hinged to the seat.

Yet a further object of the present invention is to provide a chair that includes a seat and a back rotatable in a relationship to legs and wherein the legs are hinged to the seat.

An additional object of the present invention is to provide a chair that includes a seat and a back rotatable in a relationship to legs and arm rests that are pivotally connected to both seat and back.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 2:
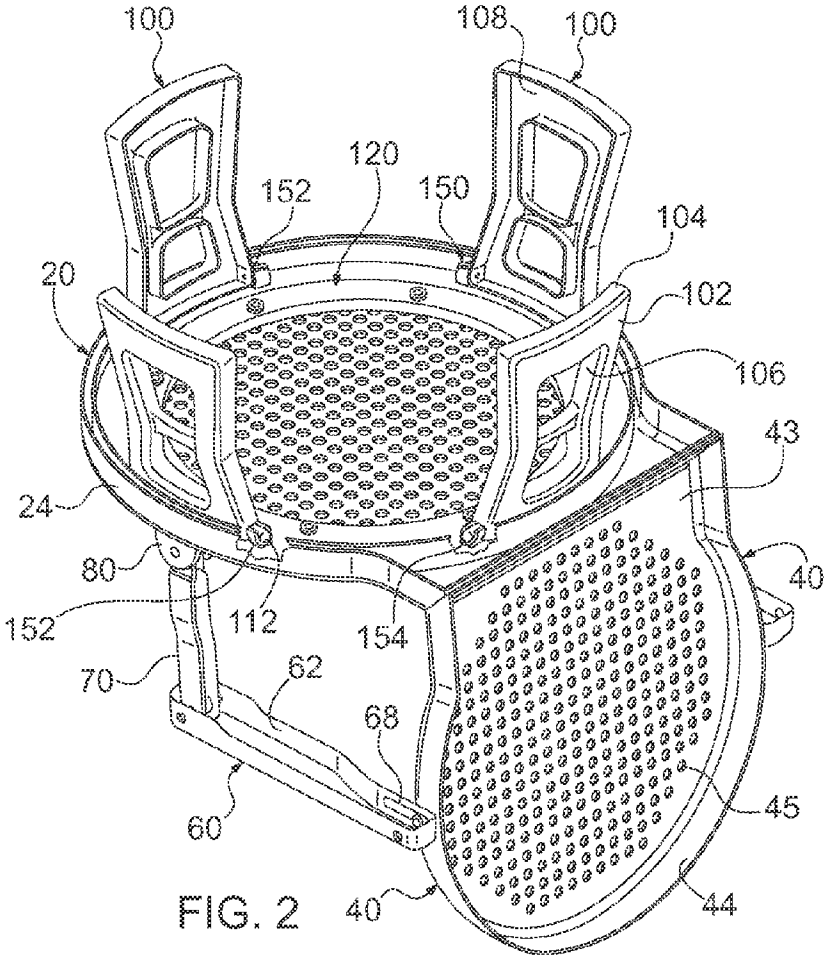
FIG. 2 is a bottom perspective view of the chair of FIG. 1, particularly illustrating one embodiment of attaching legs to a seat of the chair.

Prior to proceeding to the more detailed description of the present invention, it should be noted that, for the sake of clarity and understanding, identical components which have identical functions have been identified with identical reference numerals throughout the several views illustrated in the drawing figures.

Now in reference to FIGS. 1-12, therein is illustrated a chair, generally designated as 10, that includes a seat, generally designated as 20, having a generally planar upper surface 22 and a generally planar bottom surface 26, a peripheral flange 24 upstanding on the bottom surface 26, wherein a rear end 28 of the seat 20 is sized smaller than the remaining portion thereof and wherein the peripheral flange 24 is defined by a tapered surface 30 at the rear end 28.

A back, generally designated as 40, has a generally planar front surface 42 and a generally planar rear surface 43, a peripheral flange 44 upstanding on the rear surface 43 of the back 40, wherein a bottom end 46 of the back 40 is preferably sized smaller than the remaining portion thereof and wherein the peripheral flange 46 of the back 40 is defined by a tapered surface 48 at the bottom end 46. A pair of circular tabs 56 protrude from the exterior surfaces of the peripheral flange 44 of the back 40, diametrically opposite to one another and best shown in FIG. 3. The exterior surface of the peripheral flange 44 defines the exterior edge surface of the back 40.

Although the seat 20 and the back 40 are shown as having a generally round shape, except for the mating ends, other shapes are contemplated by the instant invention.

The instant invention contemplates that the seat 20 may be adapted with optional apertures 23 formed through a thickness thereof, the thickness defined by the spaced apart surfaces 22 and 26 and/or back 40 may be adapted with optional apertures 45 formed through a thickness thereof, the thickness of the back defined by the spaced apart surfaces 42 and 43. Although apertures 23 and 45 have been illustrated as having a round shape, any other shapes of such apertures are contemplated by the instant invention.

Figure 12:
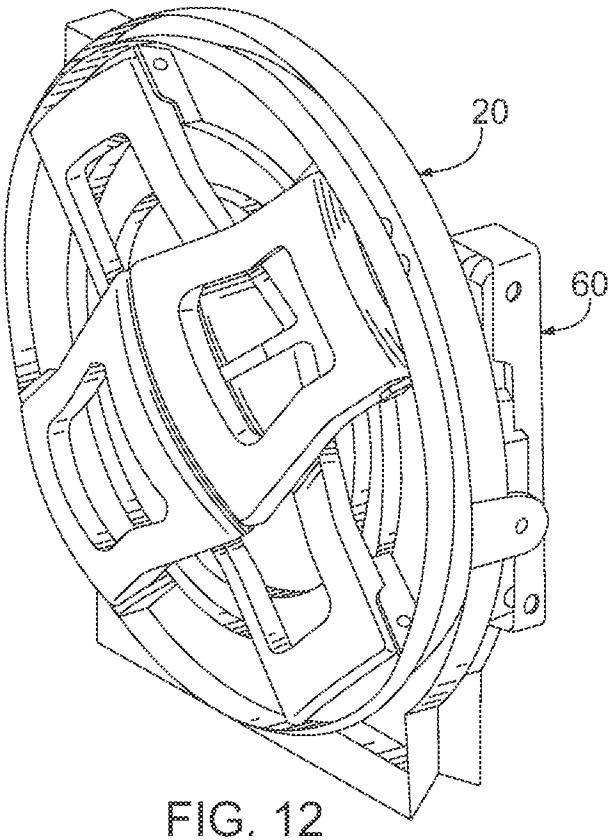
FIG. 12 is a bottom perspective view of the chair of FIG. 1 shown in folded or collapsed position.
Figure 11:
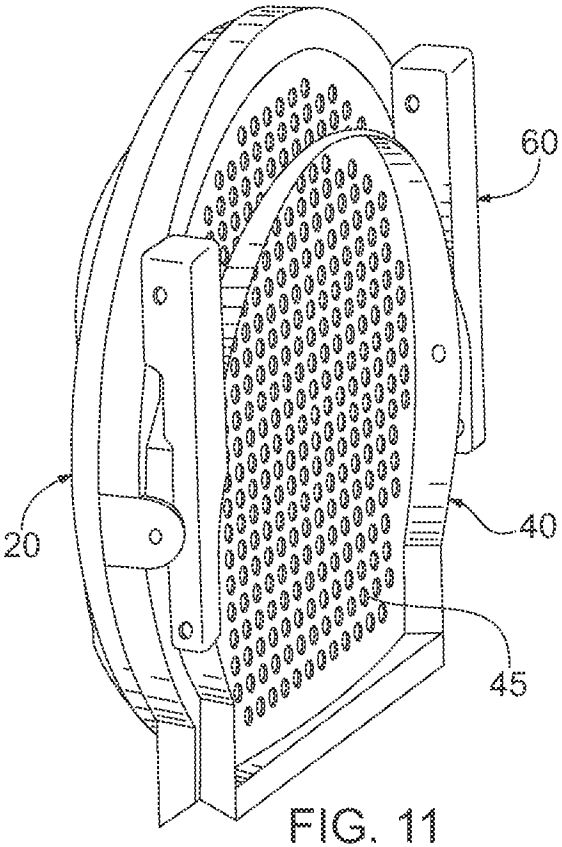
FIG. 11 is a top perspective view of the chair of FIG. 1 shown in folded or collapsed position.

Although the instant invention contemplates that the back 40 may be rigidly disposed relative to the seat 20, there is a first means, generally designated as 50, for pivotally connecting the bottom end 46 of the back 40 to the rear end 28 of the seat 20. By way of one example only of FIG. 3, the first means 50 define a hinge having a first portion 52 disposed on the rear end 28 of the seat 20 and having a second portion 54 disposed on the bottom end 46 of the back 40, wherein the first and second portions, 52 and 54 respectively, are configured to interlock by way of a pin or snap type arrangement, and wherein the first means 50 enables pivoting of the back 40 between a first position wherein the back 40 is disposed generally perpendicular to the seat 20 and a second position wherein the back 40 is disposed generally coplanar with the seat 20, as best shown in FIGS. 11-12 and as applicable during storage, carrying or transportation of the chair 10. The tapered surface 48 compliments the tapered surface 30 and essentially provides a stop for the back 40 being disposed in the first position. The instant invention also contemplates that the first and second portions, 52 and 54 respectively, may be provided as interlocking tabs or members.

There is also a pair of arms, generally designated as 60, each of the pair of arms 60 including a first portion 62 having a generally hollow interior defined by a generally U-shaped cross-section of the first portion 62 in a plane being transverse to a length thereof, a slot 68 formed through a thickness of an interior leg adjacent a rear end of the first portion 62, an aperture 66 formed through a thickness of an exterior leg adjacent a rear end of the first portion 62, and an aperture 66 formed through thicknesses of both legs adjacent a front end 64 of the first portion 62. The width of the slot 68 is sized to receive there within the above described tab 56, thus allowing a pivotal interface between the back 40 and the arm 60. A second portion 70 is sized to be received within the hollow interior of the first portion 62. The second portion 70 has a pair of apertures 72 and 76, each of the pair of apertures 72 and 76 formed through a thickness of the second portion 70 adjacent a respective end thereof. A pin 78, or equivalent, is inserted, during assembly, through apertures 66 and 72 so as to secure the pivotal connection between the first and second portions 62 and 70 respectively.

There are also two pairs of spaced apart brackets 80 disposed on the top surface 22 of the seat 20 diametrically opposite to one another and having an aperture 82 formed through a thickness thereof and aligned with aperture 76 in one end of the second portion 70. The bottom end 74 of the second portion 70 is sized to be received between the brackets 80. A pin 84, or equivalent, is inserted, during assembly, through apertures 76 and 82 so as to secure the pivotal connection between the second portion 70 and the brackets 80.

In operation, the second portion 70 pivots about the first portion 62 and is nestled or received within the hollow interior of the first portion 62 when the back 40 is in the second position described above. Thus, the pivotal connection between the arm 60 and the seat 20 and back 40 and between first and second portions, 62 and 70 respectively, allows the arms 60 to selectively fold and unfold as a follow up to movement of the back 40 between the first and second positions.

Figure 1:
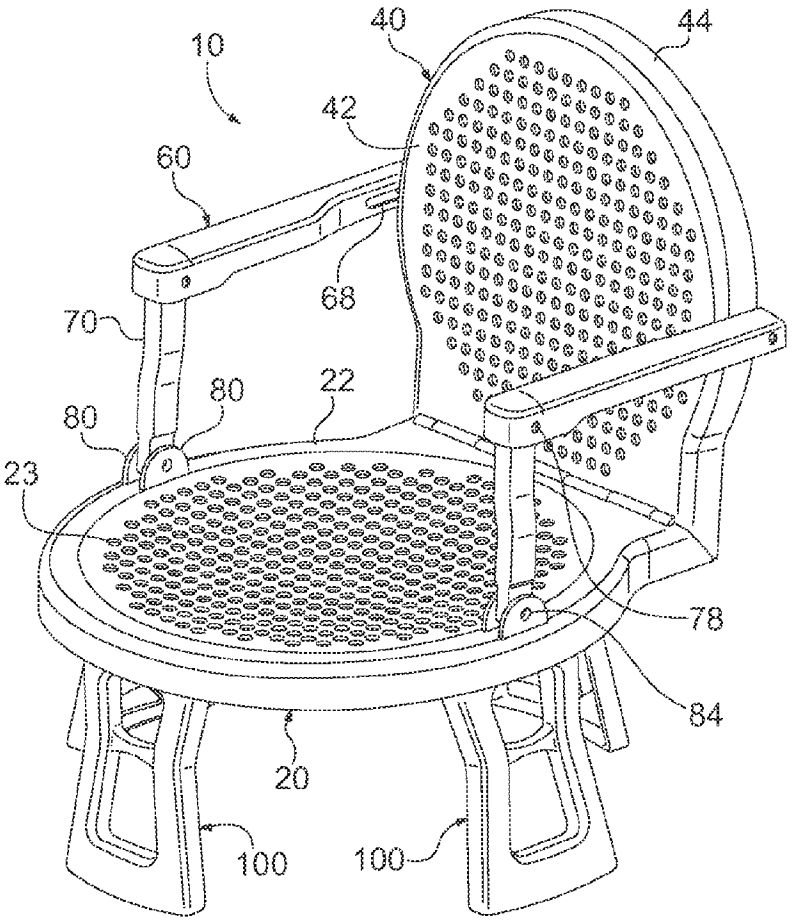
FIG. 1 is a front perspective view of a swivel and foldable chair of the invention.
Figure 3:
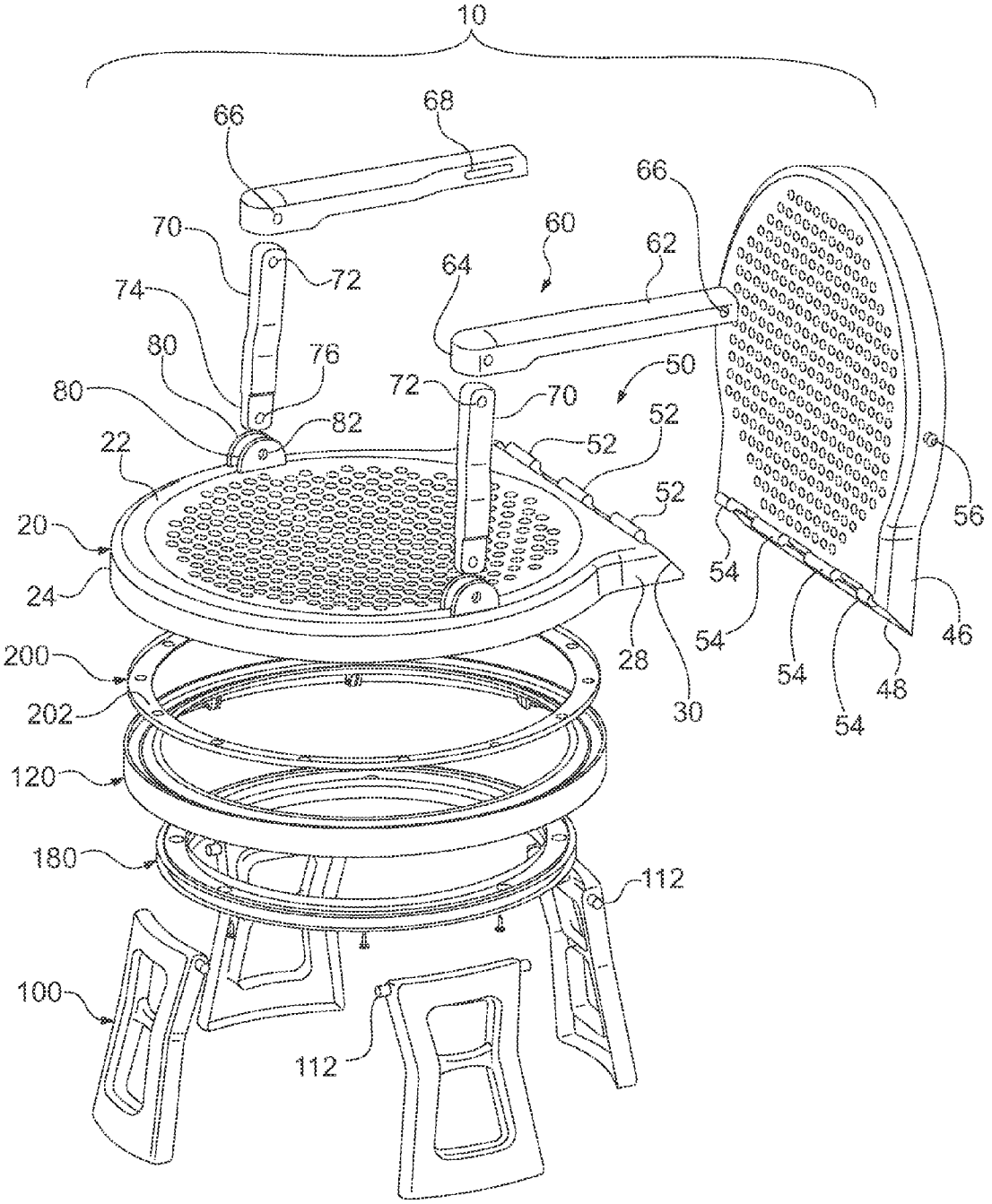
FIG. 3 is an exploded perspective view of the chair of FIG. 1, also illustrating the embodiment of attaching legs to the seat of the chair of FIG. 2.
Figure 4:
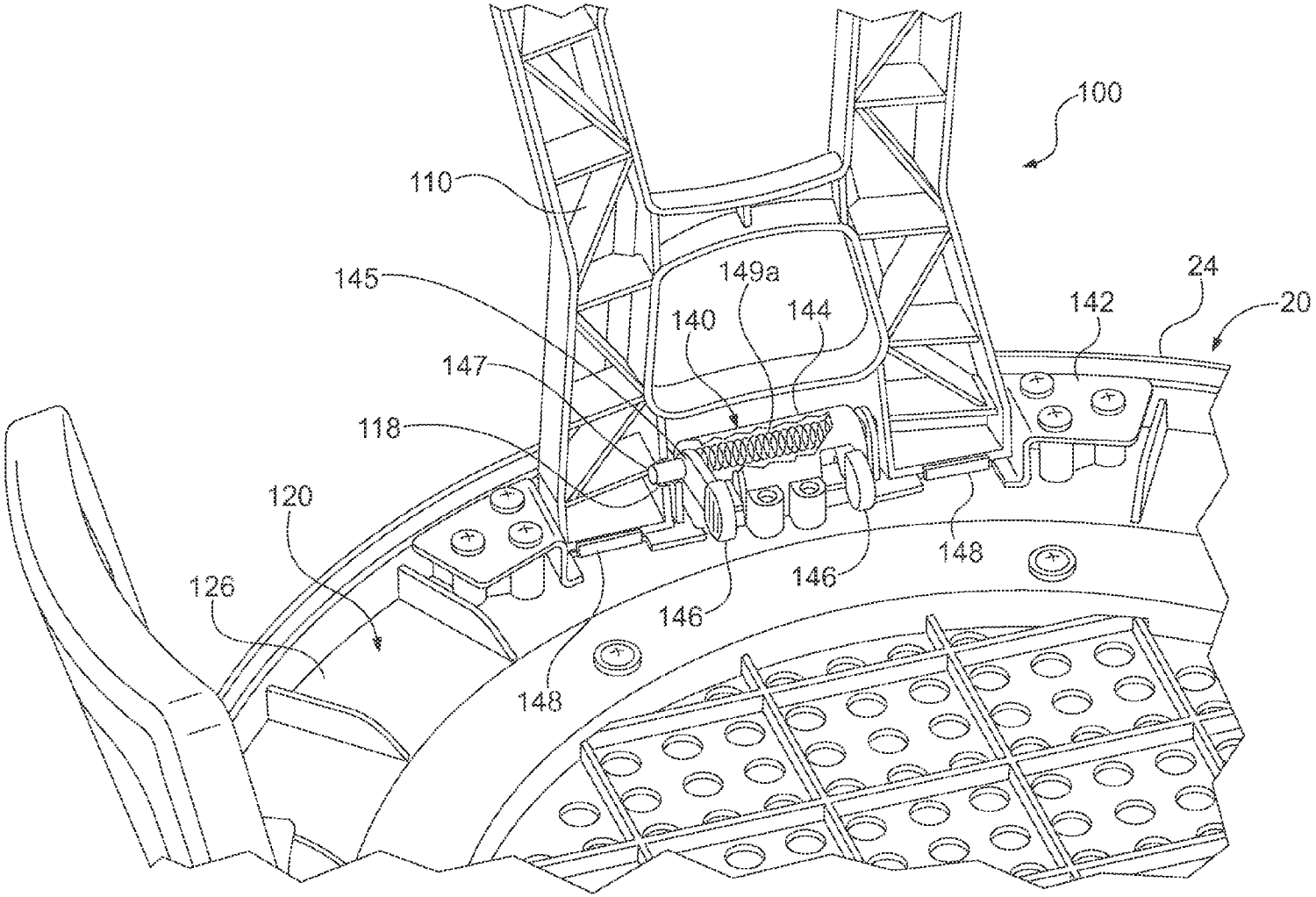
FIG. 4 is a partial bottom perspective view of the chair of FIG. 1, particularly illustrating another embodiment of attaching legs to a seat of the chair.

In the presently preferred embodiment, a quartet of chair legs, generally designated as 100 and best shown in FIGS. 1-3, is also provided in an arrangement where each leg 100 is disposed 90° from the next. Each leg 100 is shown as being molded in a Figure-8 shape, having a generally planar outer surface 102 and a generally planar inner surface 108, a peripheral outer flange 104 and a peripheral inner flange 106, in two places. The presently preferred embodiment of each leg 100 includes multiple interior support flanges 110, as best shown in FIG. 4, connected between flanges 104 and 106, in alternative parallel and diagonal configurations. In one form, each leg 100 shown in FIG. 2 is a generally hollow interior defined with a U-shaped cross-section. A pair of circular tabs 112 may protrude from the opposite side surfaces at the top end of the leg 100 and best shown in FIG. 3. The actual number of legs 100 can vary depending on the application.

A base member, generally designated as 120, is configured to fit within the peripheral flange 24 of the seat 20 member in a close proximity to the bottom surface 26 thereof. The base member 120 has a peripheral top surface 122 configured to abut the rib 34 of the seat 20, a peripheral top surface 124 configured to abut rib 36 of the seat 20, and has a generally planar bottom surface 126.

In the presently preferred embodiment of the invention, the chair 10 includes a second means for pivotally connecting one end of each leg 100 to the base member 120. The second means is configured to allow a pivotal movement of each leg 100 between a first position wherein each leg 100 is disposed generally coplanar with the bottom surface 26 of the seat 20 during storage, carrying or transportation and an operative second position wherein each leg 100 is fully opened and extends generally perpendicular or at angle from the vertical plane to the seat 20 and is biased therewithin so that the chair 10 can be supported in an operative upright position on a surface and the allow the user to seat on the seat 20.

Figure 5:
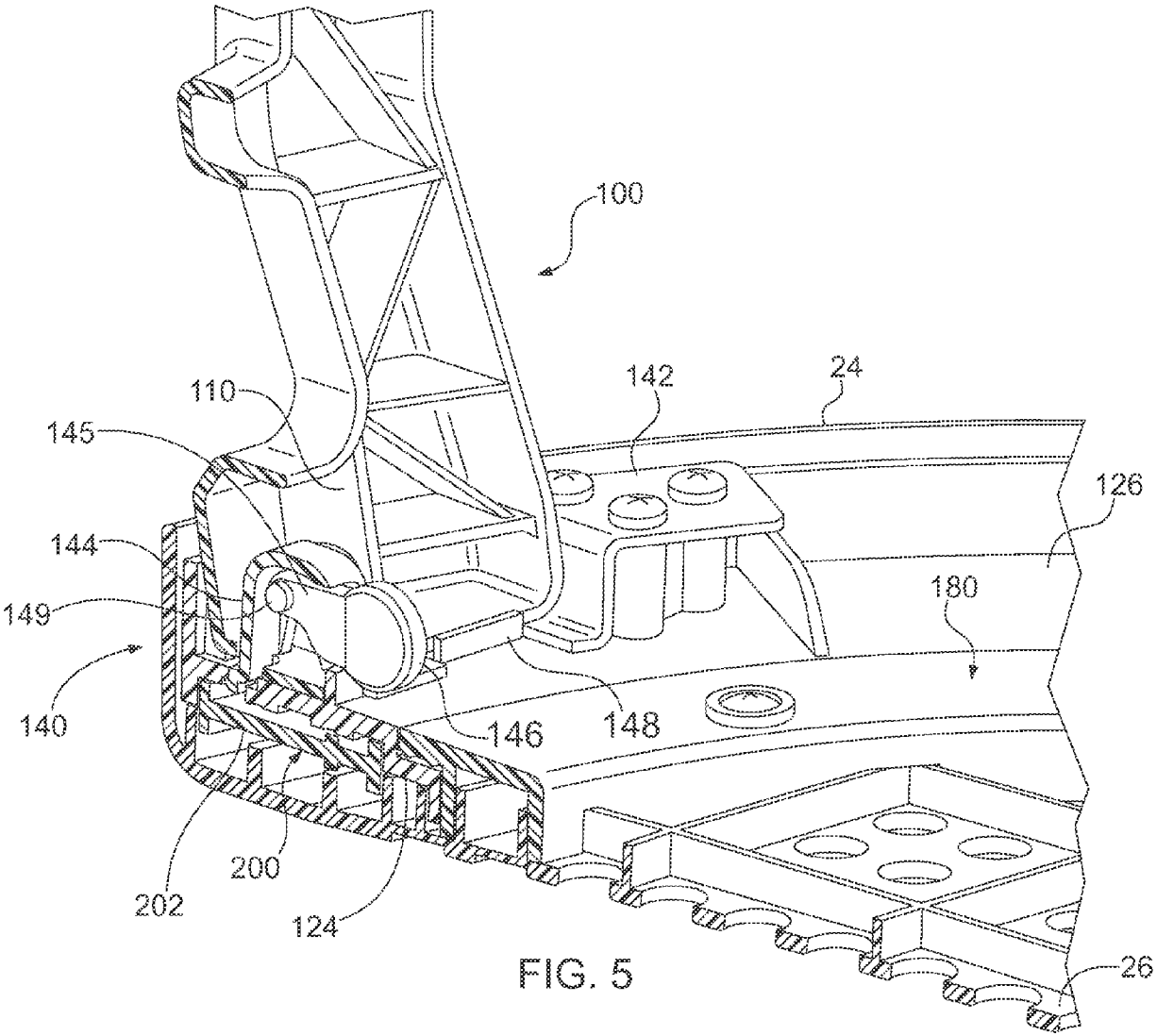
FIG. 5 is a partial cross-sectional perspective view of the chair of FIG. 4.

In one form, the second means for pivotally connecting one end of each leg 100 to a surface of the base member 120 are generally designated as 140 and are best shown in FIGS. 4-5. There is a plurality of brackets 142, each fastened to the base member 120 at a location of a respective leg 100, a hinge arrangement 144, also fastened to the base member 120 at a location of a respective leg 100, a pair of release tabs 146, mounted within hinge arrangement 144, and a pair of stops 148 provided to limit and/or control pivoting motion of the legs 100. Circular tabs 112 on the leg 100 are mounted within brackets 142, which allow the leg 100 to pivot between the first and second positions.

In addition, in a further reference to FIG. 4, the second means 140 of another form includes a pair of apertures 118 that are formed through the thickness of the interior walls towards the top end of leg 100 and pins 147 on the outer surface of portion 145 of each release tab 146. Pins 147 of the release tabs 146 are sized to fit and engage apertures 118 to secure the leg 100 and allow movement between first and second positions. The release tabs 146 are biased by a spring 149*a* disposed, in a contact with the inner surfaces of the portions 145 and seated on the tabs 149 provided on such inner surfaces of portions 145. To attach the leg 100 to the base 120 or to remove or disconnect the leg 100 therefrom, both release tabs 146 must be squeezed together (moved toward each other) to release the pins 147 from engagement with apertures 118. In this presently preferred embodiment, second means 140 is secured with fasteners to the bottom surface 126 of base member 120 via brackets 142.

In yet another form, the second means, generally designated as 150 and best shown in FIG. 2, includes a pair of mounting brackets 152 disposed on the base member 120 at a location of a respective leg 100. Circular tabs 112 snap into a cavity or groove 154 in each mounting bracket 152 to create a fit that is sufficiently tight to allow a rotation of the tab 112 without unintended separation but yet loose enough to permit the user of the chair 10 to separate the legs 100 from the base 120.

A retaining member, generally designated as 180, is secured with fasteners to the bottom surface 26 of the seat 20 and is configured to retain an inner edge of the base member 120 in a spaced relationship with the seat 20. The retaining member 180 has a peripheral flange 182 configured to abut the bottom surface 26 of the seat 20 and also has an edge portion 184 configured to abut the base member 120.

Figure 6:
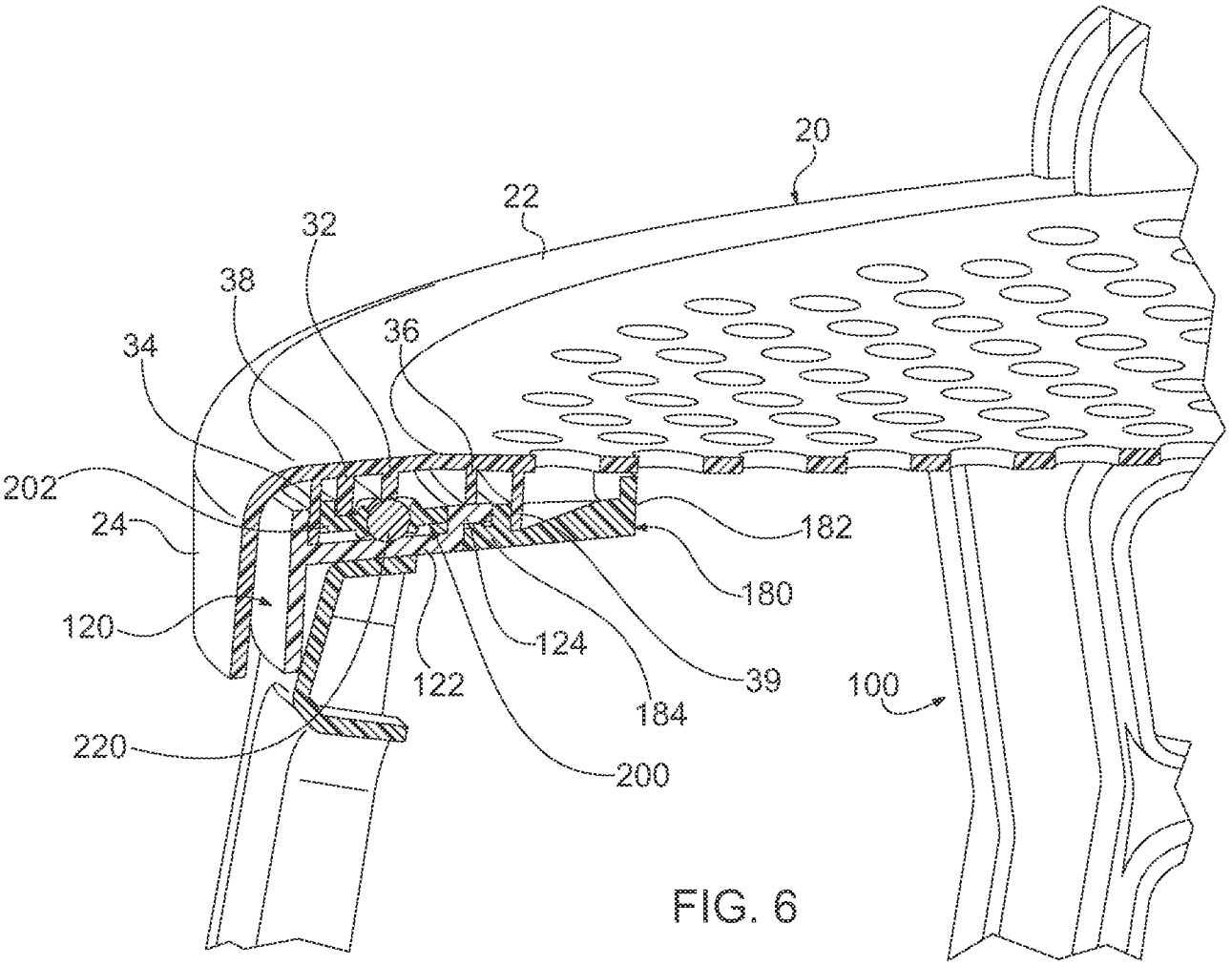
FIG. 6 is a partial cross-sectional perspective view of the chair of FIG. 1, particularly illustrating a bearing arrangement for rotating the seat relative to the legs.
Figure 8:
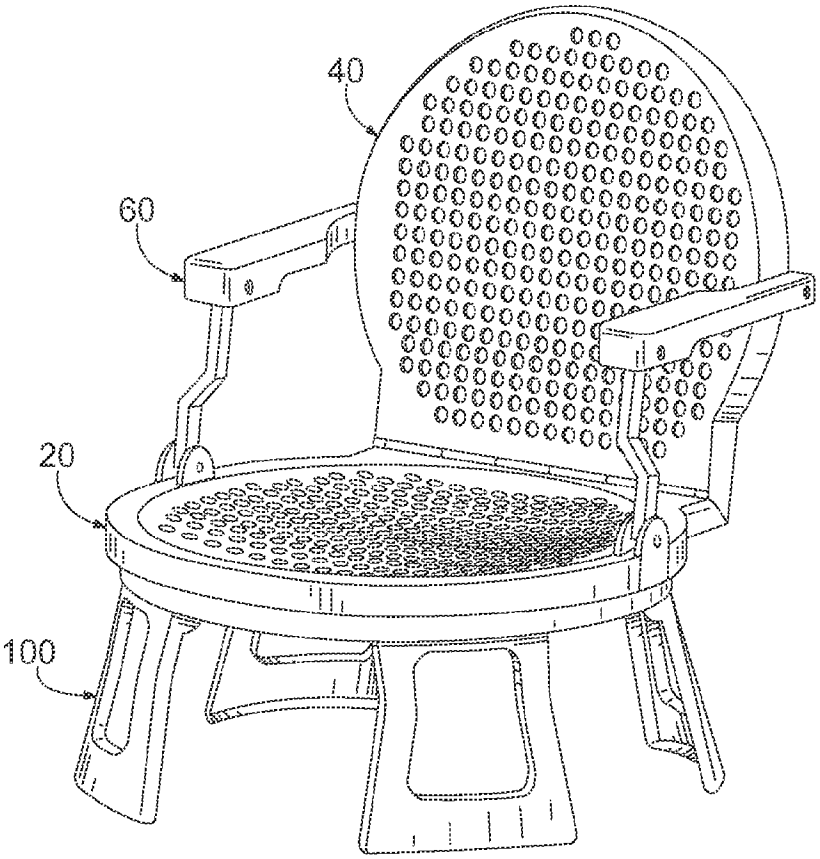
FIG. 8 is yet another front perspective view of the chair of FIG. 1.
Figure 7:
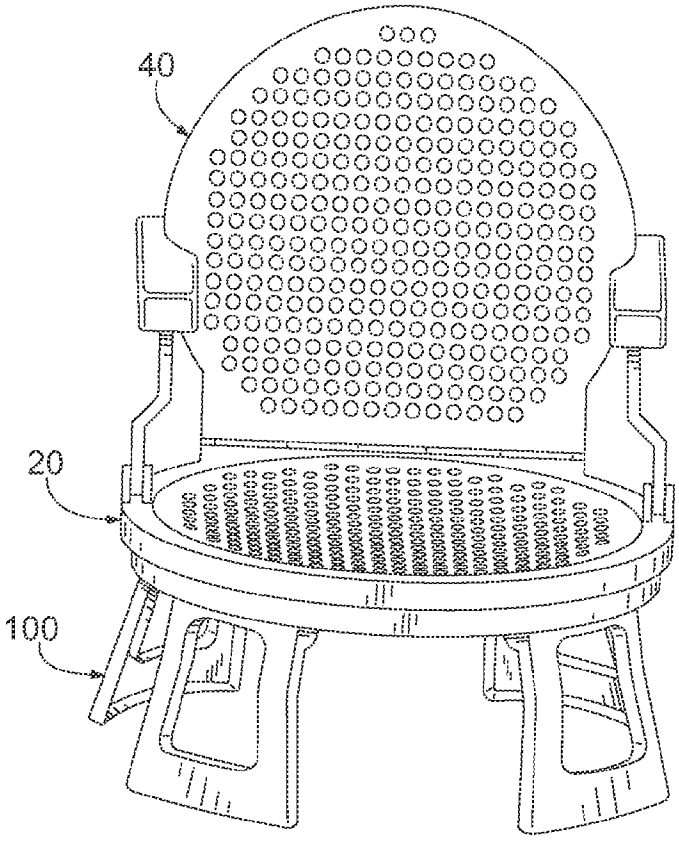
FIG. 7 is another front perspective view of the chair of FIG. 1.
Figure 10:
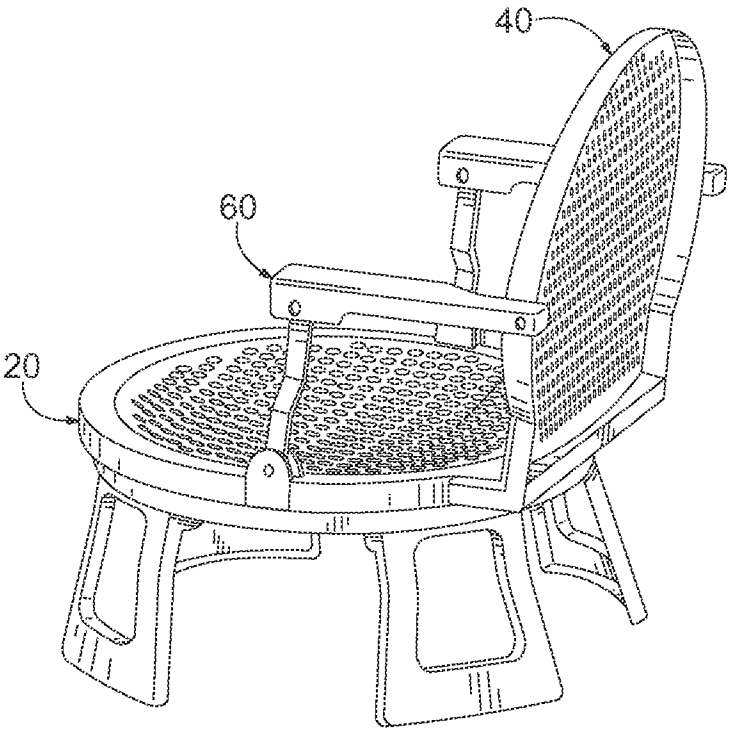
FIG. 10 is a side perspective view of the chair of FIG. 1.
Figure 9:
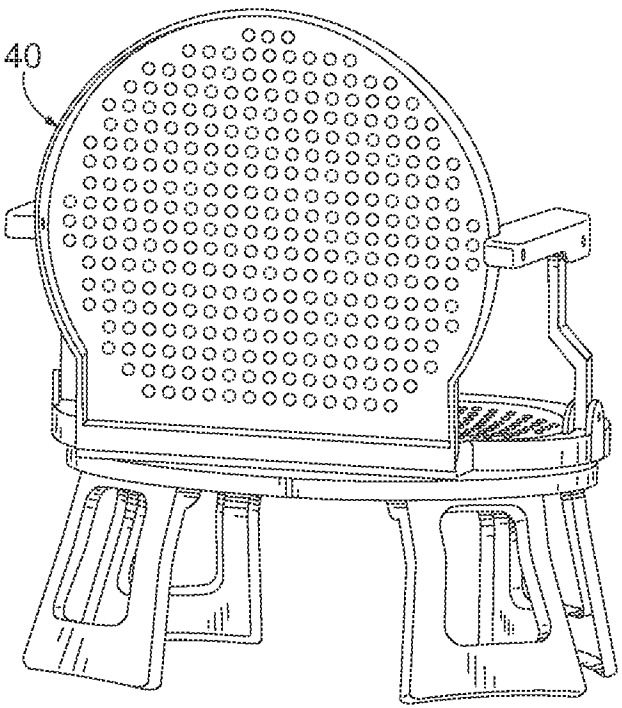
FIG. 9 is a rear perspective view of the chair of FIG. 1.

A bearing assembly, generally designated as 200 and best shown in FIGS. 5-6, includes a bearing cage 202 sized to fit within the base member 120 and plurality of bearings 220 fixed for rotation along the circumference of the bearing cage 202, the bearing assembly 200 enabling rotation of the seat 20 in relationship to the base member 120. The surface of each bearing 220 is disposed in an abutting contact with the surface of the base member 120 and one rib 32 upstanding on the bottom surface 26 of the seat 20, while a distal ends of additional ribs 34 and 36, upstanding on the bottom surface 26 of the seat 20, are disposed in an abutting contact with the surface of the base member 120 so as to space the seat 20 from the base member 120 and allow rotation of the seat 20 in relationship to the legs 100. More specifically, the rib 34 is disposed in an abutting contact with the surface 122 of the base member 120, while rib 36 is disposed in an abutting contact with the surface 124 of the base member 120. Another rib 38 also upstands on the bottom surface 26 of the seat 20 and has a distal end thereof disposed in an abutting engagement with a surface of the bearing cage 202. A final rib 39 also upstands on the bottom surface 26 of the seat 20 and has a distal end thereof disposed in abutting engagement with a surface of the retaining member 180.

Such interlocking arrangement of the seat 20, base member 120, retaining member 180 and bearing assembly 200 assures strength and stability of the chair 10 during use and effective rotation of the seat 20 and the back 40 relative to the legs 100 so that the user of the chair 10 can rotate on the seat 20 in a desired direction without physically and manually repositioning the legs 100. To use the present invention from the closed position, typical of the position that the chair 10 is stored and/or transported in, the four legs 100 of the chair 10 and the back 40 must be opened to their fully extended positions of FIGS. 1-2. In order to do so, the user preferably places closed chair 10 on the ground with the folded legs 100 facing upwards. Holding the chair seat 20 with one hand, user, with the other hand, grasps the bottom end of one leg 100 and lifts out the leg 100 until it is generally perpendicular to the seat 20. The leg 100 should snap into its open position. The user repeat the same motion with the other legs 100 until all are in their fully open position, no specific order required. When all four legs 100 are opened, the user turns the chair 10 over so that the legs 100 are supporting the chair on the ground. The second means 140 with the stops 148 are configured to prevent unintentional movement of the legs 100 back to folded positions. Now holding the front of the chair seat 20 with one hand, use the other hand to grasp the top of the back 40 and lift up the back 40 until it is perpendicular to the seat 20, in its fully opened position. The chair arms 60 will follow and the portions 62 should be parallel to the surface 22 of the seat 20. The chair 10 is now ready for use.

The present invention is intended to be used on any surfaces, such as stone, concrete, brick, asphalt, sand, grass and the like, but preferably used on a surface that is as level as possible to maximize the user's comfort level.

To close the chair 10 for transportation and/or storage, grasp the front of the seat 20 and push the top back side of the back 40 to lower the back 40 into a parallel relationship to the seat 20. The arms 60 will follow and fold down too. Turn the chair 10 over so the legs 100 are reaching upwards. With one hand, pinch the two release tabs 146 together, located at the base of a leg 100, to release the leg 100 from its opened position. Use the other hand to lower the leg 100 to the bottom of the seat 20. Repeat the same process with the leg 100 opposite to the one that was just closed. Then repeat process two more times with the remaining legs 100. By closing opposing legs 100, the chair 10 will lay in the flattest possible configuration. The chair 10 is ready to be transported and/or stored. The means 140 maintains the legs 100 in such closed position.

Advantageously, the instant invention does not require any tools to either assemble the chair 10 or configure the chair between operative configuration of FIGS. 1-2 or folded configuration of FIGS. 11-12.

Thus, in one embodiment, the invention provides a chair comprising a seat, a back, a pivotal connection between the back and the seat, a pair of arms, a plurality of legs, a means for rotating the seat, the back and the pair of arms relative to the plurality of legs, and a pivotal connection between one end of each leg and the seat.

Figure 3A:
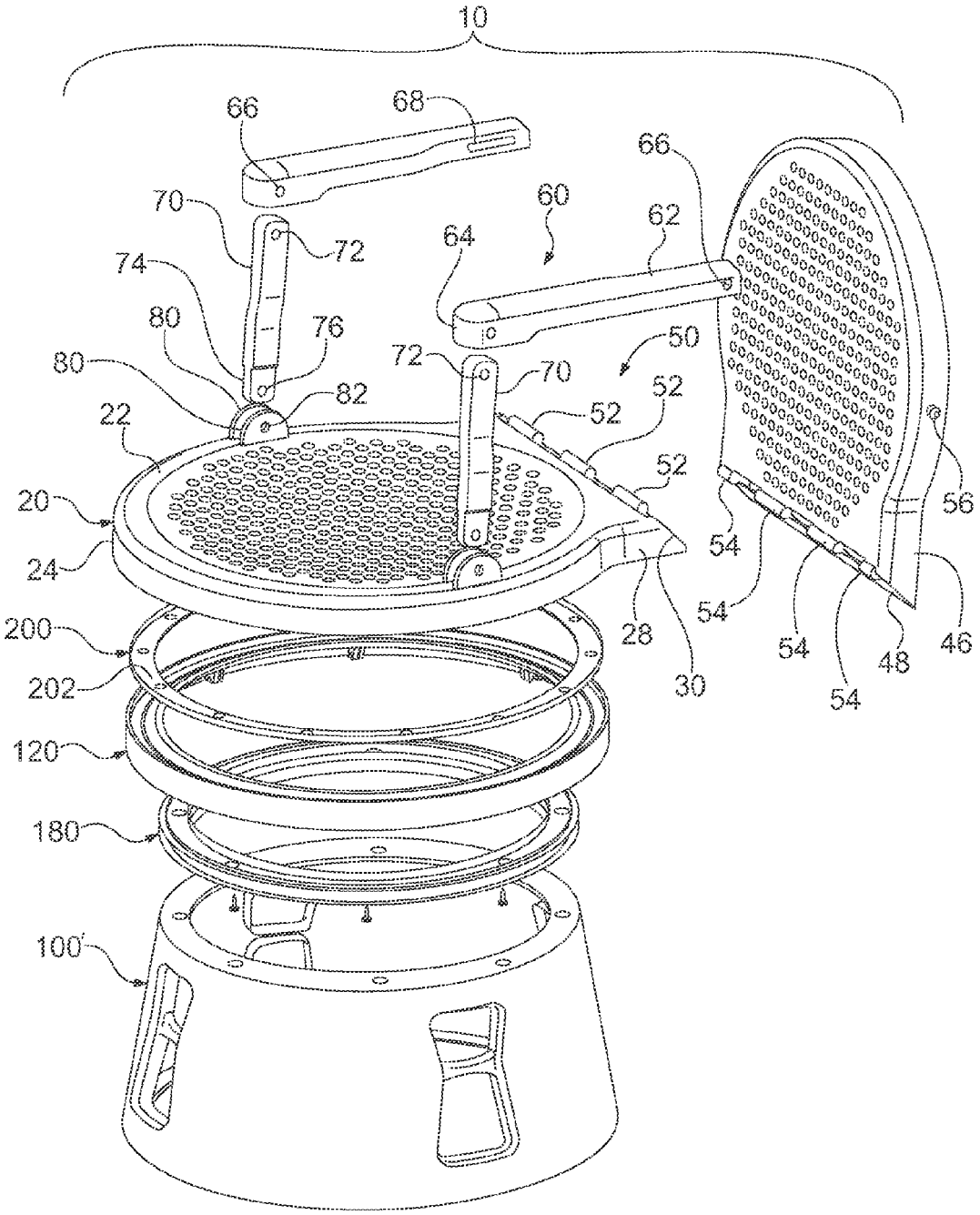
FIG. 3*a* is an exploded perspective view of the chair of FIG. 1, particularly illustrating an alternative embodiment of a single leg.

In another embodiment, the invention provides a chair comprising a seat, a back, a pivotal connection between the back and the seat, a pair of arms, a plurality of legs, a means for rotating the seat, the back and the pair of arms relative to the plurality of legs, and a rigid connection between one end of each leg and the seat. Furthermore, as best shown in FIG. 3*a*, the chair 10 is shown as being adapted with a single leg 100 that can be either fastened to the base 120 or made integral therewith, for example as by molding process. However, the invention also contemplates that the four legs 100 may be rigidly attached to the base 120, or even to the seat 20 when it is not required to rotate the seat 20.

In a further embodiment, the invention provides a chair comprising a seat, a back, a pivotal connection between the back and the seat, a pair of arms, a plurality of legs, and a non-rotatable and/or a non-pivotal connection between one end of each leg and the seat.

In yet a further embodiment, the invention provides a chair comprising a seat, a back, a pair of arms, a pivotal connection between the back and the seat, a plurality of legs, and a pivotal connection between one end of each leg and the seat.

In another embodiment, the invention provides a chair comprising a seat, a back, a rigid, non-pivotal connection between the back and the seat, a pair of arms, a plurality of legs, a means for rotating the seat, the back and the pair of arms relative to the plurality of legs, and a pivotal connection between one end of each leg and the seat.

In yet another embodiment, the chair 10 may be provided without the arms 60 and their pivotal connections between the back 40 and the seat 20.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A chair comprising:

(a) a seat;

(b) a back;

(c) a pivotal connection between said back and said seat;

(d) one or more legs; and (e) a means for rotating said seat and said back relative to said one or more legs, said means comprising:

i. a base member configured to fit within a peripheral flange of said seat in a proximity to a bottom surface thereof, ii. a retaining member secured with fasteners to a bottom surface of said seat and being configured to retain an inner edge of said base member in a spaced relationship with said seat, said retaining member has a peripheral flange configured to abut said bottom surface of said seat and further has an edge portion thereof configured to abut said base member, iii. a bearing assembly including a bearing cage sized to fit within said base member, and plurality of bearings fixed for rotation along a circumference of said bearing cage, wherein a surface of each bearing is disposed in an abutting contact with a surface of said base member, and iv. plurality of ribs, wherein one rib upstands on said bottom surface of the seat, distal ends of two other ribs upstanding on said bottom surface of said seat are disposed in an abutting contact with said surface of said base member so as to space said seat from said base member and to allow a rotation of said seat and said back in a relationship to said plurality of legs, another rib upstanding on said bottom surface of said seat and having a distal end thereof disposed in an abutting engagement with a surface of said bearing cage, and yet another rib upstanding on said bottom surface of said seat and having a distal end thereof disposed in an abutting engagement with a surface of said retaining member.

2. The chair of claim 1, further comprising:

(a) a pair of arms;

(b) a pivotal connection between one end of each arm and said seat; and (c) a pivotal connection between another end of said each arm and said back.

3. The chair of claim 2, wherein each of said pair of arms includes:

(a) a first portion having a front end, a rear end and a generally hollow interior defining a generally U-shaped cross-section of said first portion in a plane being transverse to a length thereof;

(b) a second portion sized to be received within said hollow interior of said first portion;

(c) a pivotal connection between said front end of said first portion and said one end of said second portion.

4. The chair of claim 3, wherein said pivotal connection between said one end of said each arm and said seat includes:

(a) an aperture formed through a thickness of one end of said second portion of said each arm;

(b) a pair of spaced apart brackets upstanding on said top surface of said seat adjacent an edge thereof, forward from a rear end of said seat, each of said pair of spaced apart brackets having an aperture formed through a thickness thereof and aligned with said aperture formed in said one end of said second portion; and (c) a pin extending through said aligned apertures.

5. The chair of claim 3, wherein said pivotal connection between said another end of said each arm and said back includes:

(a) a slot formed through a thickness of an interior leg adjacent a rear end of said first portion;

(b) an aperture formed through thicknesses of both legs adjacent a front end of said first portion; and (c) a pin upstanding on an exterior edge surface of said back and extending into said slot.

6. The chair of claim 1, wherein said seat includes a generally planar upper surface and a generally planar bottom surface, a peripheral flange upstanding on said bottom surface, wherein a rear end of said seat is sized smaller than a remaining portion thereof and wherein said peripheral flange is defined by a tapered surface at said rear end.

7. The chair of claim 1, wherein said back includes a generally planar upper surface and a generally planar bottom surface, a peripheral flange upstanding on said bottom surface of said back, wherein a bottom end of said back is sized smaller than a remaining portion thereof and wherein said peripheral flange of said back is defined by a tapered surface at said bottom end.

8. The chair of claim 1, wherein said pivotal connection between said back and said seat includes a hinge having first portions disposed on said rear end of said seat in a spaced apart relationship with each other and having first portions disposed on said bottom end of said back in a spaced apart relationship with each other and interlocking with said first portions, said hinge provides for pivoting of said back between a first position wherein said back is disposed generally perpendicular to said seat and a second position wherein said back is disposed generally coplanar with said seat.

9. The chair of claim 1, further comprising a pivotal connection between one end of each leg and said seat.

10. The chair of claim 9, wherein said pivotal connection between said one end of said each leg and said seat includes:

(a) a pair of brackets upstanding on a bottom surface of said seat;

(b) a cavity provided in each bracket;

(c) a pair of tabs extending from opposite side edge surfaces of said each leg, each sized and shaped to operatively fit within a respective cavity.

11. The chair of claim 9, wherein said pivotal connection between said one end of said each leg and said seat includes:

(a) a pair of brackets upstanding on a bottom surface of said seat and fastened thereto;

(b) a hinge coupled to said seat;

(c) a pair of member mounted within said hinge, each having a tab with a pin extending into an aperture provided in said each leg; and (d) a pair of stops provided to limit and/or control pivoting motion of said each leg.

12. The chair of claim 1, further comprising apertures formed through a thickness of at least one of said seat and said back.

13. A chair comprising:

(a) a seat;

(b) a back;

(c) a pivotal connection between said back and said seat;

(d) one or more legs mounted in a pivotal or a non-pivotal manner relative to a surface of said seat;

(e) a pair of arms;

(f) pivotal connections between each arm and said seat and between each said arm and said back; and (g) a means for rotating said seat, said pair of arms and said back relative to said one or more legs, said means comprising:

i. a base member configured to fit within a peripheral flange of said seat in a proximity to a bottom surface thereof, ii. a retaining member secured with fasteners to a bottom surface of said seat and being configured to retain an inner edge of said base member in a spaced relationship with said seat, said retaining member has a peripheral flange configured to abut said bottom surface of said seat and further has an edge portion thereof configured to abut said base member, iii. a bearing assembly including a bearing cage sized to fit within said base member, and plurality of bearings fixed for rotation along a circumference of said bearing cage, wherein a surface of each bearing is disposed in an abutting contact with a surface of said base member, and iv. plurality of ribs, wherein one rib upstands on said bottom surface of the seat, distal ends of two other ribs upstanding on said bottom surface of said seat are disposed in an abutting contact with said surface of said base member so as to space said seat from said base member and to allow a rotation of said seat and said back in a relationship to said plurality of legs, another rib upstanding on said bottom surface of said seat and having a distal end thereof disposed in an abutting engagement with a surface of said bearing cage, and yet another rib upstanding on said bottom surface of said seat and having a distal end thereof disposed in an abutting engagement with a surface of said retaining member.

14. The chair of claim 13, further comprising a means for pivotally connecting said one or more legs to said seat.

15. The chair of claim 14, wherein said one or more legs is a plurality of legs, wherein each leg includes a pair of tabs extending from opposite side edge surface thereof, wherein said means for pivotally connecting said plurality of legs to said seat includes a base member rigidly attached to a bottom surface of said seat and a pair of brackets for each of said plurality of legs, each bracket having a cavity formed therein, said cavity sized and shaped to operatively receive a respective tab.

16. A chair comprising:

(a) a seat having a generally planar upper surface and a generally planar bottom surface, a peripheral flange upstanding on said bottom surface, wherein a rear end of said seat is sized smaller than a remaining portion thereof and wherein said peripheral flange is defined by a tapered surface at said rear end;

(b) a back having a generally planar upper surface and a generally planar bottom surface, a peripheral flange upstanding on said bottom surface of said back, and a pair of pins upstanding on an exterior surface of said peripheral flange diametrically opposite to each other, wherein a bottom end of said back is sized smaller than a remaining portion thereof and wherein said peripheral flange of said back is defined by a tapered surface at said bottom end;

(c) a means for pivotally connecting said bottom end of said back to said rear end of said seat, said means including a hinge having a first portion disposed on said rear end of said seat and having a second portion disposed on said bottom end of said back and interlocking with said first portion, said means enabling pivoting of said back between a first position wherein said back is disposed generally perpendicular to said seat and a second position wherein said back is disposed generally coplanar with said seat;

(d) a pair of arms, each of said pair of arms including:

i. a first portion having a generally hollow interior defining a generally U-shaped cross-section of said first portion in a plane being transverse to a length thereof, a slot formed through a thickness of an interior leg adjacent a rear end of said first portion, said interior leg abutting or disposed in a proximity to an exterior surface of said peripheral flange, said slot sized to receive a respective pin therethrough and an aperture formed through thicknesses of both legs adjacent a front end of said first portion, ii. a second portion sized to be received within said hollow interior of said first portion, said second portion having a pair of apertures, each of said pair of apertures formed through a thickness of said second portion adjacent a respective end thereof, and iii. two pair of spaced apart brackets disposed on said top surface of said seat diametrically opposite to one another and having aperture formed through thickness thereof and aligned with apertures in one end of said second portion;

(e) a base member configured to fit within a peripheral flange of said seat in close proximity to a bottom surface thereof;

(f) a retaining member secured with fasteners to a bottom surface of said seat and being configured to retain an inner edge of said base member in a spaced relationship with said seat, said retaining member has a peripheral flange configured to abut said bottom surface of said seat and further has an edge portion thereof configured to abut said base member;

(g) a bearing assembly including:

i. a bearing cage sized to fit within said base member, and ii. plurality of bearings fixed for rotation along a circumference of said bearing cage, wherein a surface of each bearing is disposed in an abutting contact with a surface of said base member; and (h) plurality of ribs, wherein one rib upstands on said bottom surface of the seat, distal ends of two other ribs upstanding on said bottom surface of said seat are disposed in an abutting contact with said surface of said base member so as to space said seat from said base member and to allow a rotation of said seat and said back in a relationship to said plurality of legs, another rib upstanding on said bottom surface of said seat and having a distal end thereof disposed in an abutting engagement with a surface of said bearing cage, and yet another rib upstanding on said bottom surface of said seat and having a distal end thereof disposed in an abutting engagement with a surface of said retaining member;

(i) one or more legs; and (j) a means for pivotally connecting said one or more legs to said base member, wherein said one or more legs pivot between a first position wherein said one or more legs are disposed generally coplanar with said bottom surface of said seat and an operative second position wherein said one or more legs are fully opened and extend generally perpendicular or at angle from a vertical plane to said bottom surface of said seat.

* * * * *